US006088873A

United States Patent [19]

Pacchini et al.

[11] Patent Number: 6,088,873

[45] Date of Patent: Jul. 18, 2000

[54] FLOOR CLEANING MACHINE AND METHOD

[75] Inventors: David Pacchini, Chicago; Matthew B. Potter, Hinsdale, both of Ill.

[73] Assignee: Breuer Electric Mfg. Co., Chicago, Ill.

[21] Appl. No.: 08/954,598

[22] Filed: Oct. 20, 1997

[51] Int. Cl.[7] ..... A47L 5/00

[52] U.S. Cl. ..... 15/320; 15/340.3; 15/371

[58] Field of Search ..... 15/320, 368, 385, 15/412, 340.3, 371

[56] References Cited

U.S. PATENT DOCUMENTS

| | | | |
|---|---|---|---|
| 3,197,798 | 8/1965 | Brown et al. | 15/320 |
| 4,339,841 | 7/1982 | Waldhauser et al. | 15/320 |
| 4,483,041 | 11/1984 | Waldhauser et al. | 15/320 |
| 4,805,256 | 2/1989 | Mason et al. | 15/385 |
| 5,369,838 | 12/1994 | Wood et al. | 15/385 |
| 5,465,456 | 11/1995 | Fellhauer et al. | 15/320 |
| 5,477,578 | 12/1995 | Duncan et al. | 15/385 |
| 5,522,114 | 6/1996 | Allison | 15/385 |
| 5,566,422 | 10/1996 | Geyer | 15/320 |
| 5,611,105 | 3/1997 | Blehert et al. | 15/320 |

*Primary Examiner*—Robert J. Warden, Sr.
*Assistant Examiner*—Andrew Aldag
*Attorney, Agent, or Firm*—Jack E. Dominik

[57] ABSTRACT

A floor cleaning machine having a body in which the body cover assembly is hollow and serves as the recovery solution reservoir; while the lower body assembly, which is also hollow, serves as the cleaning solution tank or reservoir. In addition, the lower body has a recessed area proportioned to receive and secure the batteries required for driving the motors involved in the floor cleaning machine. A trans-axle drive supports the lower body and has a drive wheel at each end powered by a motor differential engaging the axles coupled to the wheels. Together the body and trans-axle drive comprise a modular power unit. Mounting means are provided on the forward portion of the lower body of the power unit for lift arms to be secured to various power floor scrubbers for use on hard floors or a carpet extractor for cleaning carpeted floors. The linkage for the floor scrubber mode and carpet cleaning mode is the same. Such linkage also uses a maximum number of resiliently mounted bushings which, along with the monocoque body and retained fluid movement, cushion against damage by impact under power.

7 Claims, 15 Drawing Sheets

FLOOR CLEANING MACHINE AND METHOD

BACKGROUND OF THE INVENTION

The subject matter of this invention is directed to a floor cleaning machine. More particularly it relates to a floor cleaning machine which has a cleaning solution tank, a recovery tank, a battery compartment, power supply, and means for accepting a floor scrubbing heads for various hard surface floors, or even a carpet cleaning head for carpeted floors.

SUMMARY OF THE PRIOR ART

Commercial floor scrubbing machines are known in the industry. Most such machines have dedicated rotating brushes and fluid dispensing means for cleaning either hard floors or carpeted floors. Such machines are usually self-propelled by battery driven electric motors. Exemplary of such a machine is recently issued U.S. Pat. No. 5,611,105, issued Mar. 18, 1997. This patent discloses a floor scrubbing machine. The disclosure is particularly directed to its asserted ability to resist impact by hoisting itself into the air when colliding with a wall or other obstacle. It should be noted that the scrubber taught in the '105 patent has a very substantial frame adding significantly to its weight. In addition, there is no hint in the subject patent that its power unit can be adapted readily for various floor carpet cleaning modes.

Accordingly, what is desired to advance the art in floor cleaning machines is one in which the power unit is simplified and modularized not only to handle various sizes and widths of floor cleaning equipment, but to readily adapt itself to an operational use with a variety of floor scrubbers or even a carpeted floor cleaner. An additional problem is to address the construction of a floor scrubber or carpet cleaner which is inherently designed to accommodate the impact of a collision with a fixed object.

SUMMARY OF THE INVENTION

The present invention of a floor cleaning machine is attributable to developing a body in which the body cover assembly is hollow and serves as the recovery solution reservoir; while the lower body assembly, which is also hollow, serves as the cleaning solution tank or reservoir. In addition, the lower body has a recessed area proportioned to receive and secure the batteries required for driving the motors involved in the floor cleaning machine. A trans-axle drive supports the lower body and has a drive wheel at each end powered by a motor differential engaging the axles coupled to the wheels. Together the body and trans-axle drive comprise a modular power unit. Mounting means are provided on the forward portion of the lower body of the power unit for lift arms to be secured to various power floor scrubbers for use on hard floors or a carpet extractor for cleaning carpeted floors. The linkage for the floor scrubber mode and carpet cleaning mode is the same. Such linkage also uses a maximum number of resiliently mounted bushings which, along with the monocoque body and retained fluid movement, cushion against damage by impact under power. Similarly, mounts are provided at the rear portion of the power unit to engage linkages for a squeegee to follow the floor scrubber or, alternatively, a vacuum nozzle rake assembly to follow the carpet cleaner when in the carpet cleaning mode. As such, the subject cleaner has a functional monocoque frameless body power unit with the multi-fold capability of using various floor scrubber heads or carpet cleaner heads. The method of the invention is directed to forming the sub-assembly of the floor cleaner power unit which can be adapted for either a floor scrubber or a carpet cleaner. Thereafter, the unit is converted to the one mode or the other depending upon the customer order being filled. Finally, the entire body portion is supported by a trans-axle power unit. The trans-axial drive at a mid-position of the monocoque secured body structure also resists torsional stress applied at various ends of the body. The method also includes proportioning the various controls and location of the batteries so that the composite center of gravity of the unit at all times is toward the rear of the trans-axle drive. The composite center of gravity of the cleaning solution, recovery solution, and drive unit with its power modes is at all times located rearwardly of the trans-axle. This positioning of the center of gravity inhibits the possibility of the floor cleaner tipping forwardly.

In view of the foregoing it is a principal object of the present invention to provide a power unit for a floor cleaning machine, and the accessories for such power unit for hard floor scrubbing and/or carpet cleaning. Each of the floor scrubbing and carpet cleaning accessories may be readily interchanged with the other. Additionally, the power unit and the linkage thereon can support floor scrubber assemblies and carpet cleaning assemblies of various widths. Such convertability fulfills the objective of reducing manufacturing costs by modularizing the power unit which can be adapted to at least three different sizes of scrubbers, and three different sizes of carpet cleaners, without modifying the power unit.

In view of the above object, it is a further objective of the present invention to reduce the manufacturer's inventory significantly by providing a power unit which is adaptable to either the hard floor scrubbing mode or the carpet cleaner mode.

A further and correlative advantage of the present invention is to significantly reduce the cost of the overall scrubber unit or carpet unit delivered for service to the user by eliminating the traditional frame reducing the number of parts, and reducing the man hours required to assemble the scrubber or carpet cleaner.

A further purpose of the lifting assembly is to apply an affirmative load to the scrubber assembly above and beyond the tare weight of the same. Experience has shown that an affirmative brush load, while in the scrubbing mode, of between twenty and one hundred fifty pounds is desired for maximum cleaning effectiveness, depending upon the condition of the floor. The dramatic difference is between stucco and linoleum, or painted cement, and a non-skid walkway. To achieve this end, the down force on the lifting assembly is such that it can transfer one to one hundred pounds of the weight of the power unit to the scrubbing or carpet cleaning assembly.

BRIEF DESCRIPTION OF THE ILLUSTRATIVE DRAWINGS

Further objects and advantages of the present invention will become apparent as the following description of an illustrative embodiment takes place in conjunction with the accompanying drawings, in which.

Figure 13:
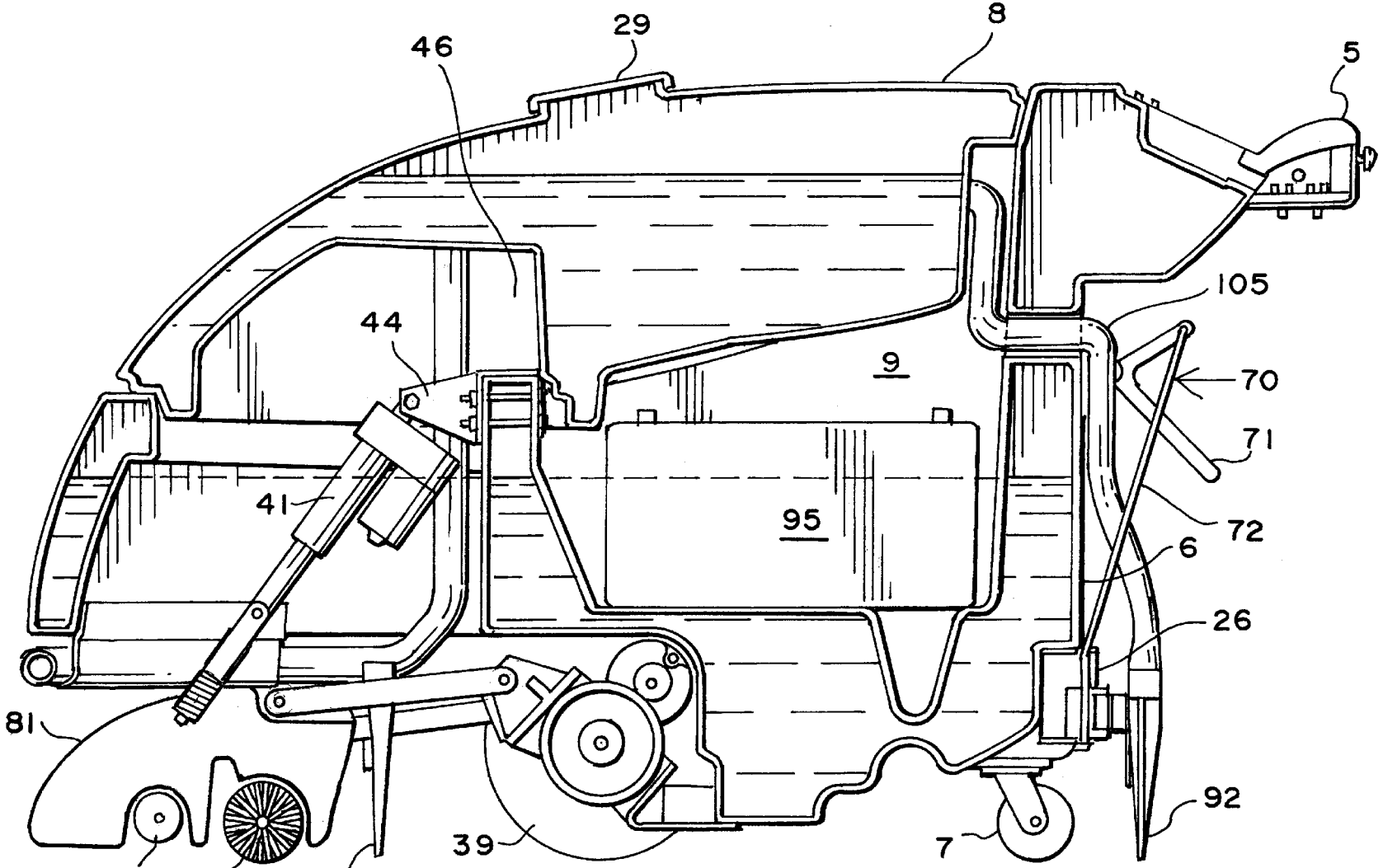
FIG. 13 is a longitudinal sectional partially diagrammatic view of the entire power unit depicted in an illustrative carpet cleaning mode particularly illustrate the position and orientation of the cleaning solution within the lower body and the recovery solution within the cover tank.
Figure 17:
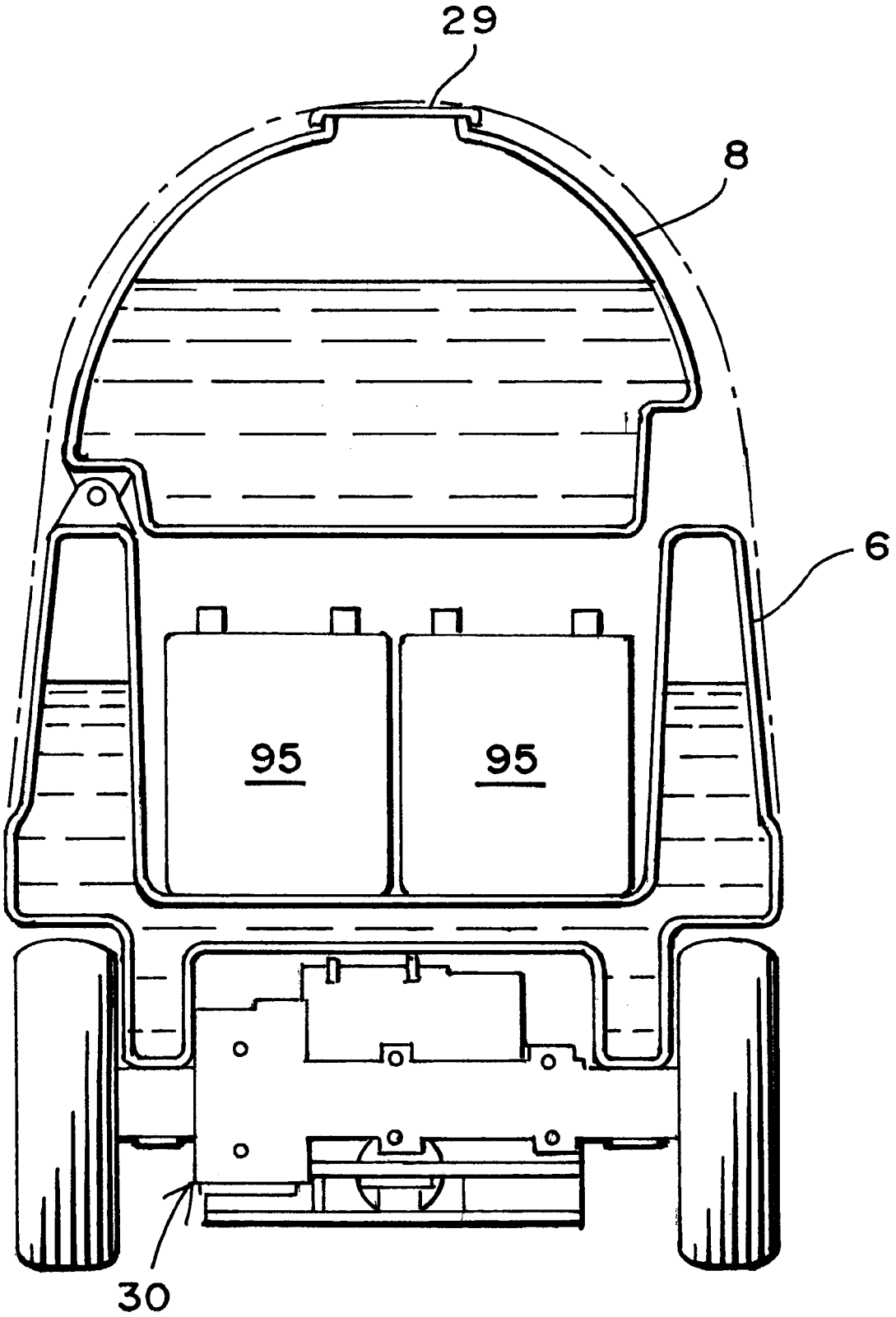
Figure 18:
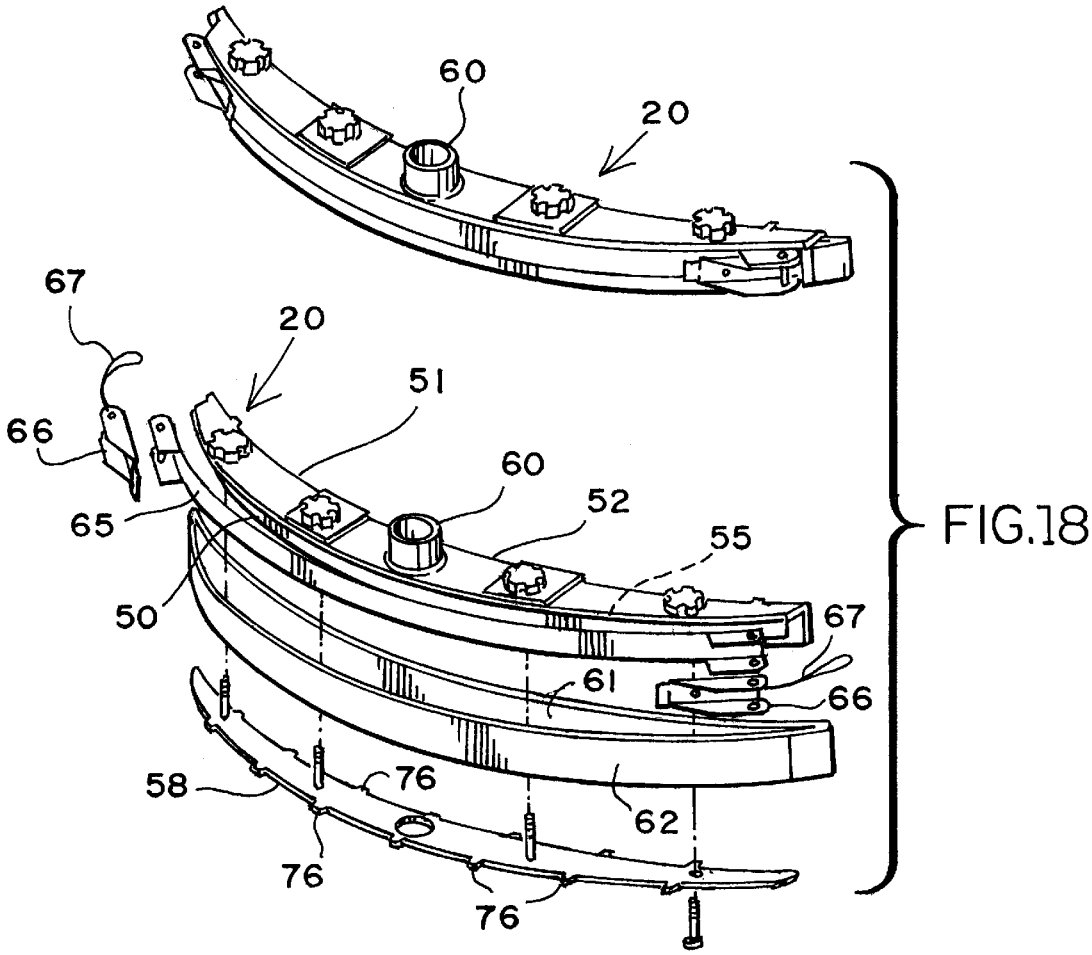
Figure 19:
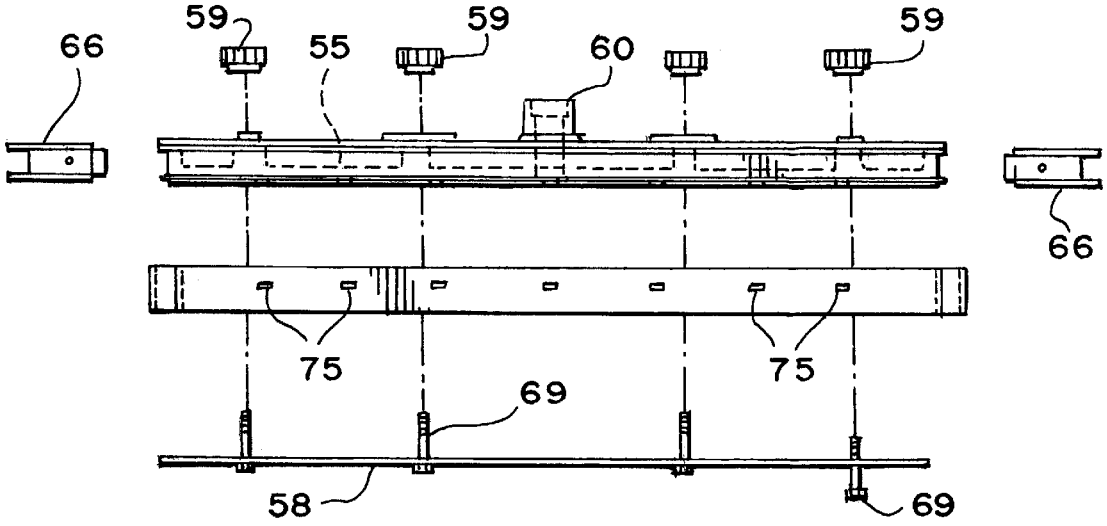
Figure 21:
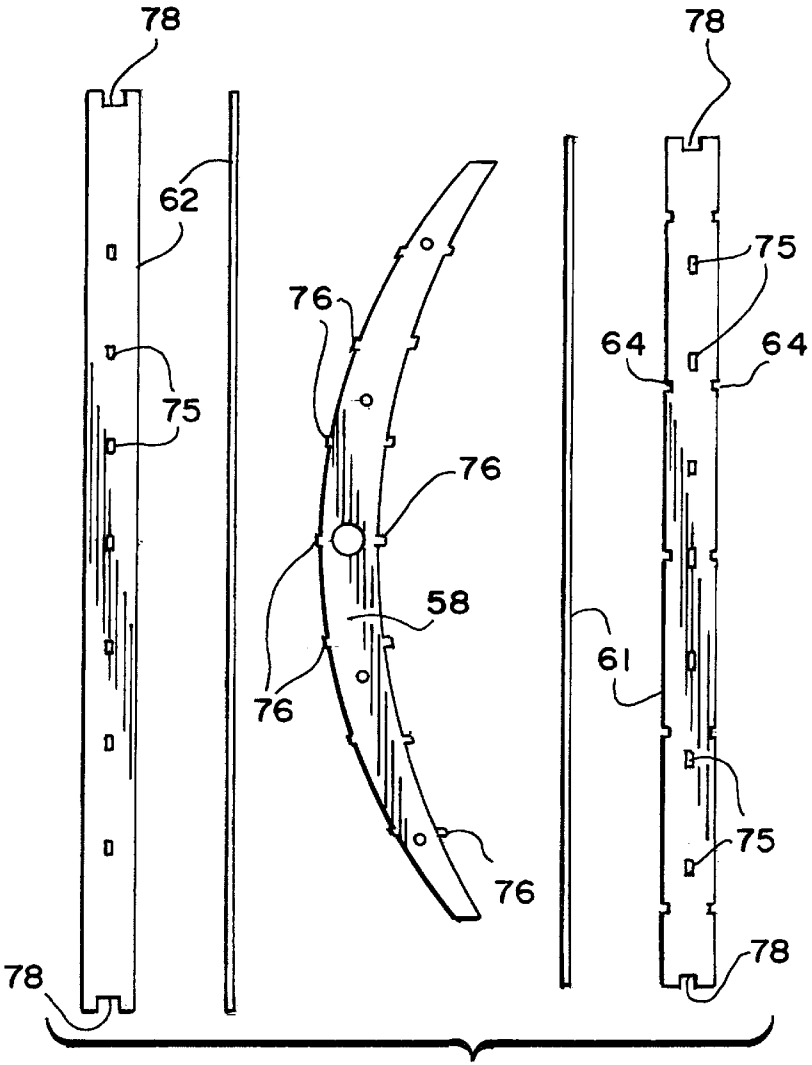
Figure 20:
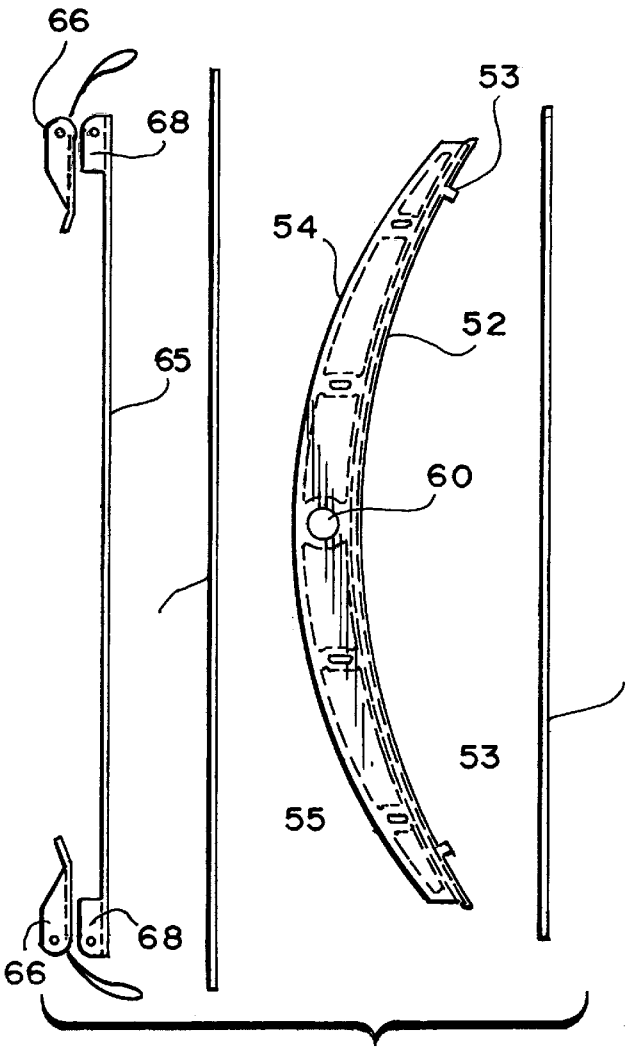
Figure 22:
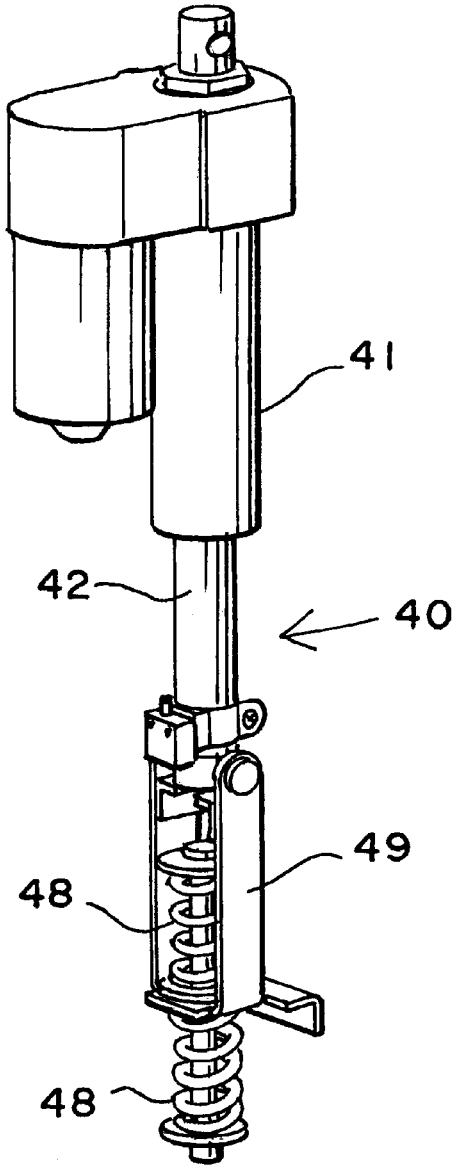
Figure 23:
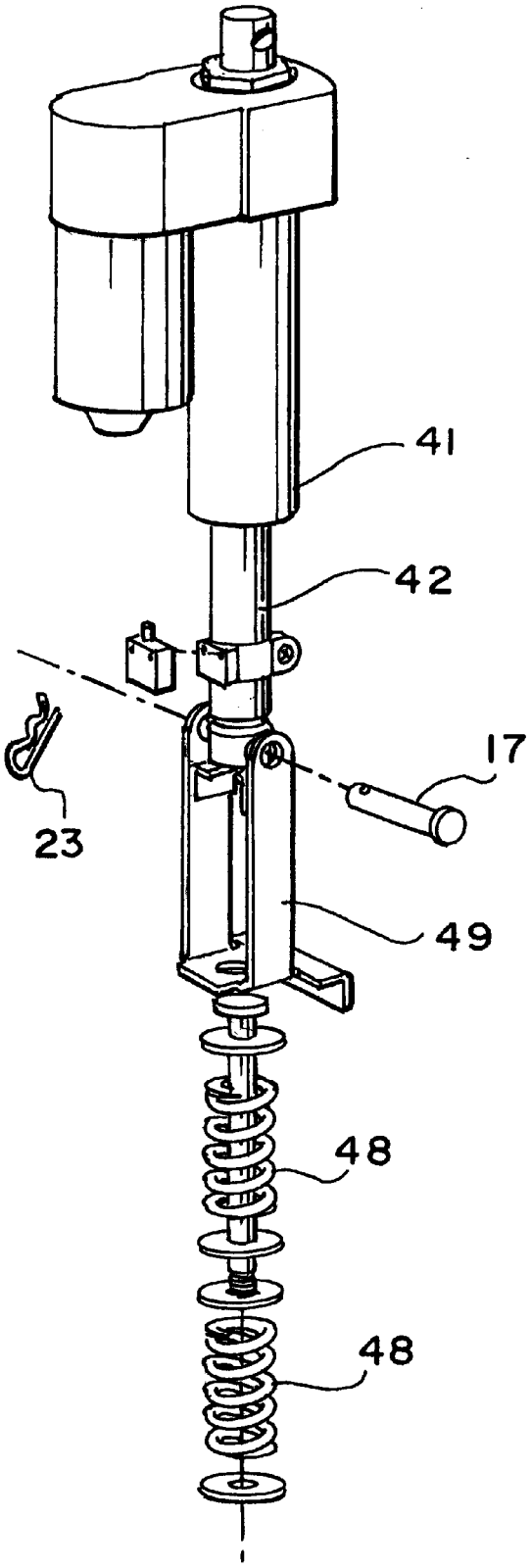
Figure 24:
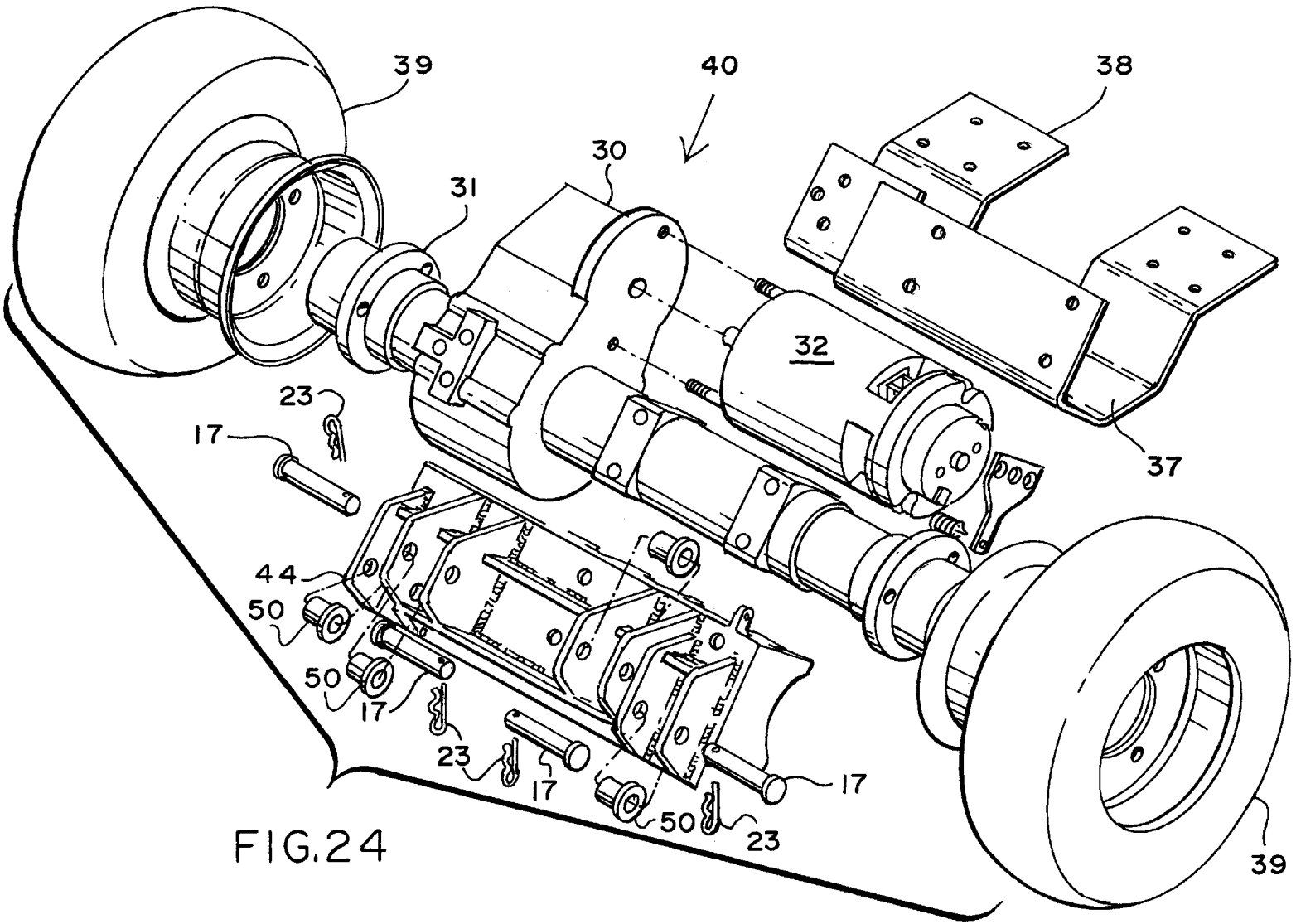

FIG. 17, when contrasted to FIG. 13, illustrates a transverse sectional view through the center of the trans-axle and specifically illustrating the fluid level in the recovery tank and the cleaning solution tank;

FIG. 18 is a composite perspective partially exploded view of the squeegee assembly;

FIG. 19 is a front elevation view, partially exploded, of the squeegee assembly;

FIG. 20 is a plan view exploded of the squeegee assembly showing the casting, front blade, rear blade, and squeegee clamp band;

FIG. 21 is a further front elevation detailed view comparable to that of FIG. 20, but illustrating the means for securing the front squeegee and the rear squeegee to the squeegee assembly casting;

FIG. 22 is a perspective view of the height control actuator portion of the linkage group;

FIG. 23 is an exploded perspective of the actuator shown in FIG. 22; and FIG. 24 is an enlarged exploded perspective view of the trans-axle drive assembly.

DESCRIPTION OF A PREFERRED EMBODIMENT

Figure 1:
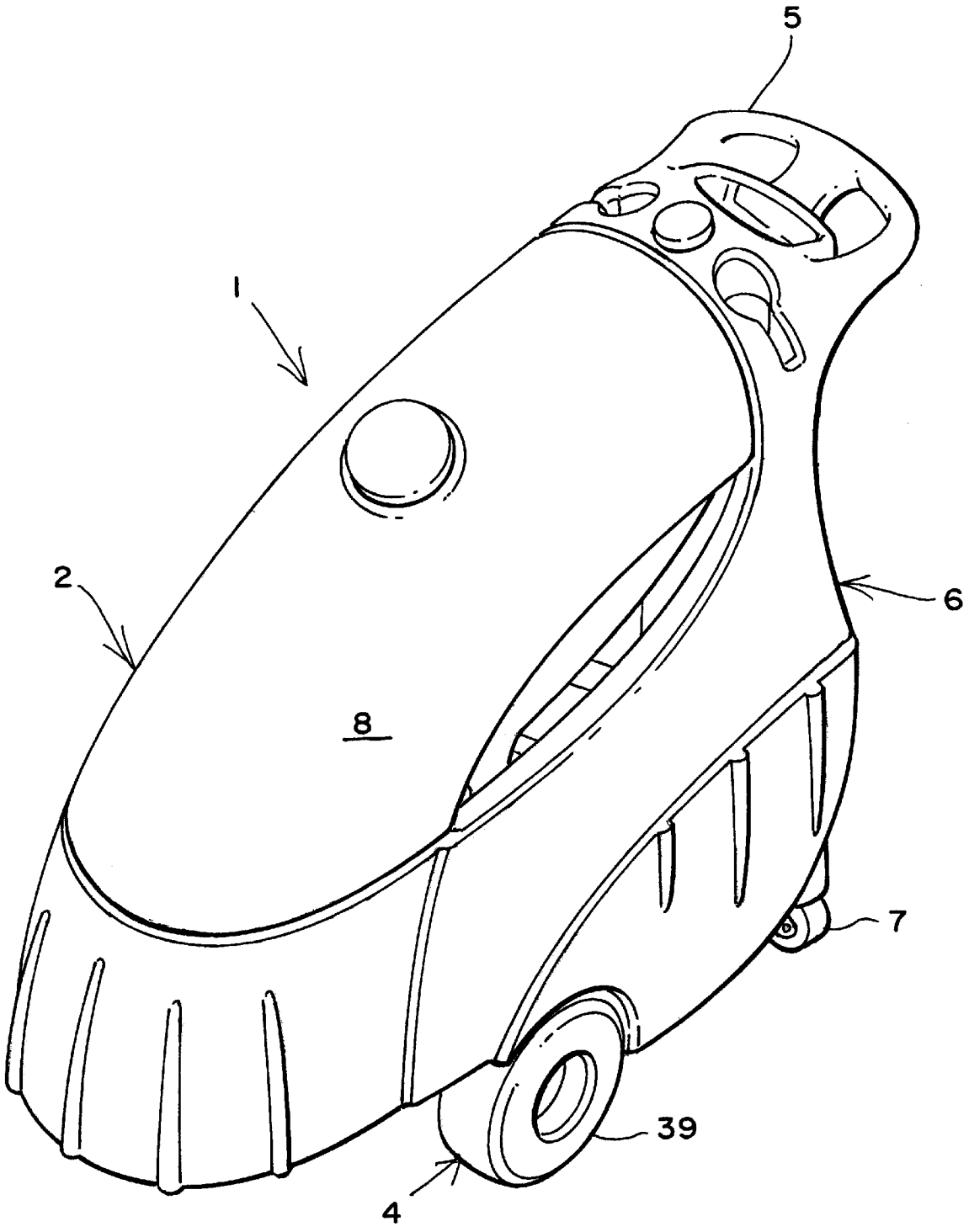
FIG. 1 is a perspective view of the drive assembly of the floor cleaning machine illustrative of the present invention.
Figure 2:
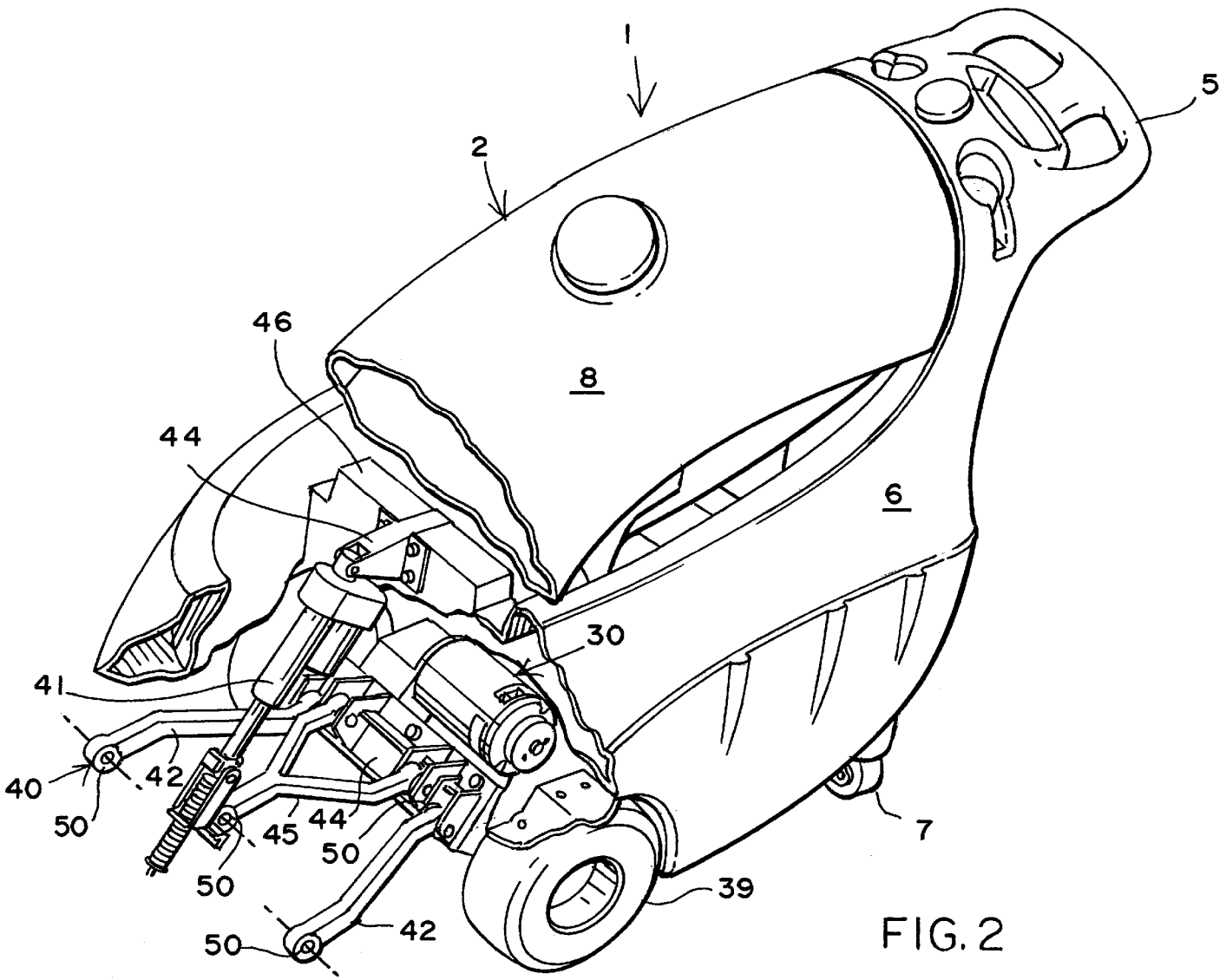
FIG. 2 is a partially broken view of the drive assembly shown in FIG. 1 with the front portion cut away to illustrate the linkage for engaging various a floor scrubbing heads or a carpet cleaning head.
Figure 3:
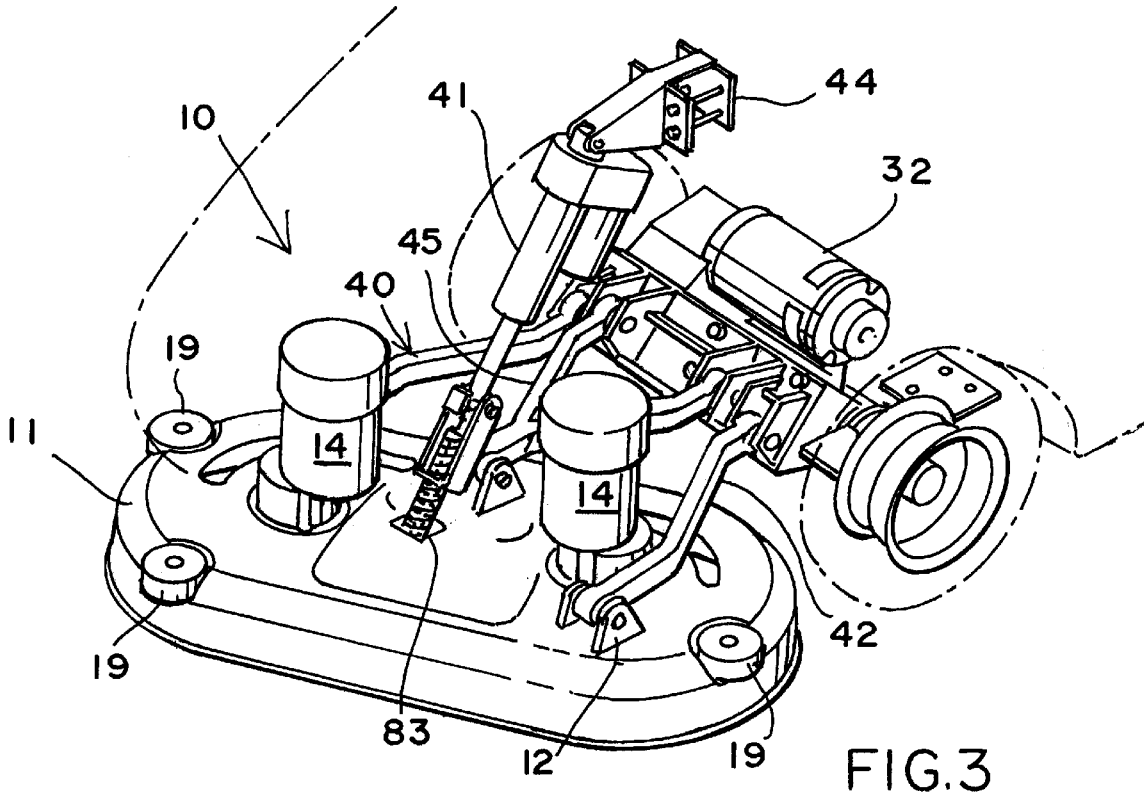
FIG. 3 is a perspective view of the floor scrubbing head as secured to the linkage located in the forward portion of the unit as shown in FIG. 2.
Figure 5:
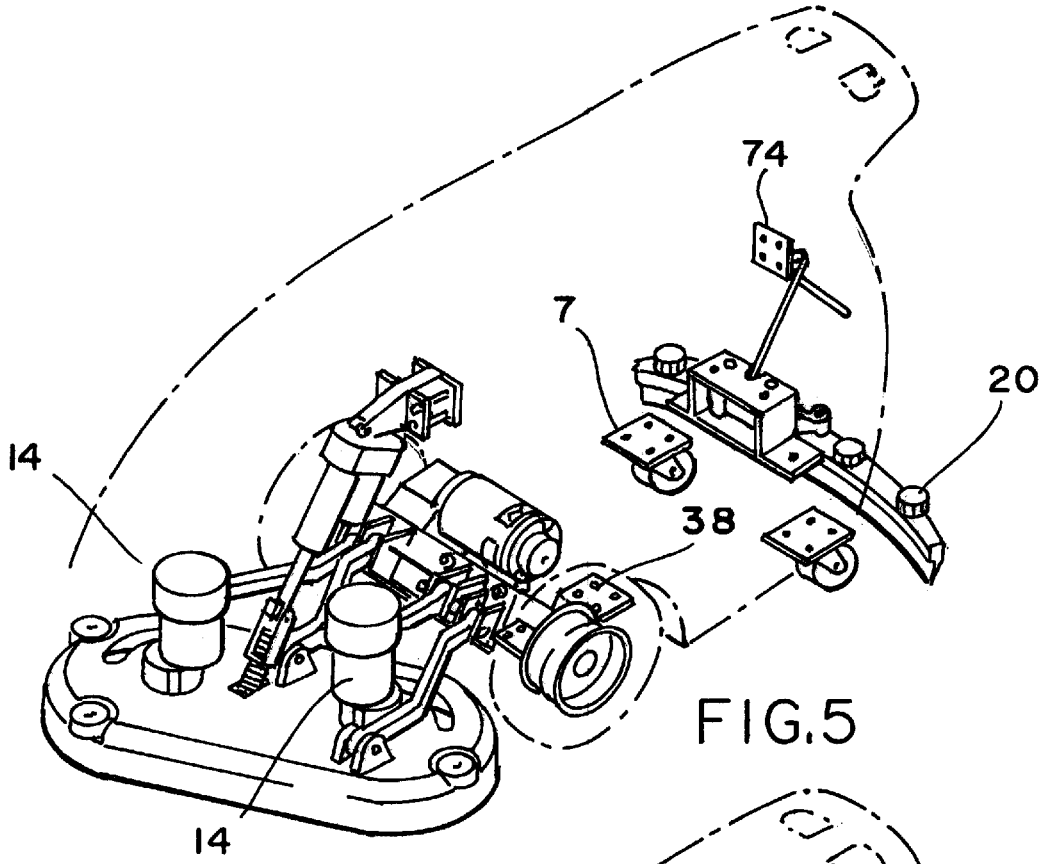
FIG. 5 is a further perspective view of the floor scrubbing head and the trailing squeegee illustrating their relationship to the drive assembly, which assembly is illustrated in dotted lines.

As stated above, the invention is directed to a floor cleaning machine 1 such as that illustrated in FIG. 1. The floor cleaning machine has as its principal element a hollow body portion 2. The entire hollow body portion is supported by a wheel assembly, such as that illustrated in FIG. 8. Two wheels 39 are secured to a trans-axle power drive 30 which, in turn, is secured to the lower body assembly 6. The casters 7 are secured to the under portion of the lower body assembly 6 at the rear of the lower body assembly 6. The power unit is controlled and maneuvered by the handle 5 positioned above the casters 7. The body cover assembly 8 is hollow to contain the recovery fluid. Similarly, the lower body assembly 6 is also hollow to contain the cleaning solution. Hence, the overall body 2 is made up primarily of two hollow fluid retention members, one of which retains the clean water or cleaning solution, and the other of which carries the recovered fluid. Batteries 65 for driving all propulsion and solution and floor-engaging functions of the floor cleaning machine 1 are secured interiorly of the lower body assembly 6 as will appear in detail hereafter. Finally, as is illustrated in FIGS. 2,3, the floor scrubbing head 10 is secured to the forward portion of the floor cleaning machine 1 by the linkage group 40, and as is illustrated in FIG. 5. The squeegee assembly 20 is secured to the rear portion of the main body 2.

Figure 4:
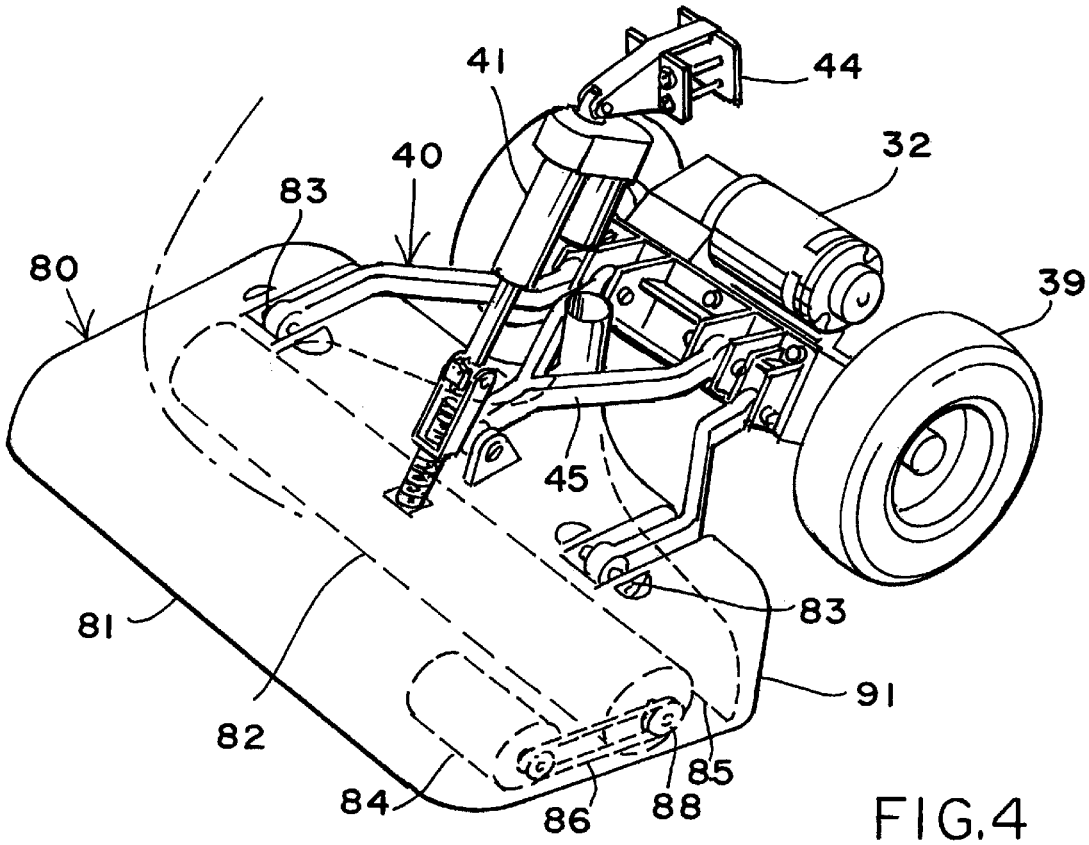
FIG. 4 is a perspective view of a carpet cleaning head as secured to the linkage illustrated in FIG. 2.

Alternatively, as is illustrated in FIG. 4, the carpet cleaning head 80 is secured to the forward portion of the floor cleaning machine 1 by the same links which secure the floor scrubbing head. Both the floor scrubbing head 10 and carpet cleaning head 80 are raised and lowered by the power linkage group 40. The various linkages are all secured to their pivotal mounts cushioned in resilient bushings 50 and removably secured clevis pins 17 secured in place by removable clevis pin keys 23, the latter eliminating the need for wrenches, screw drivers, and other tools for assembly or disassembly.

Figures 11, 12:
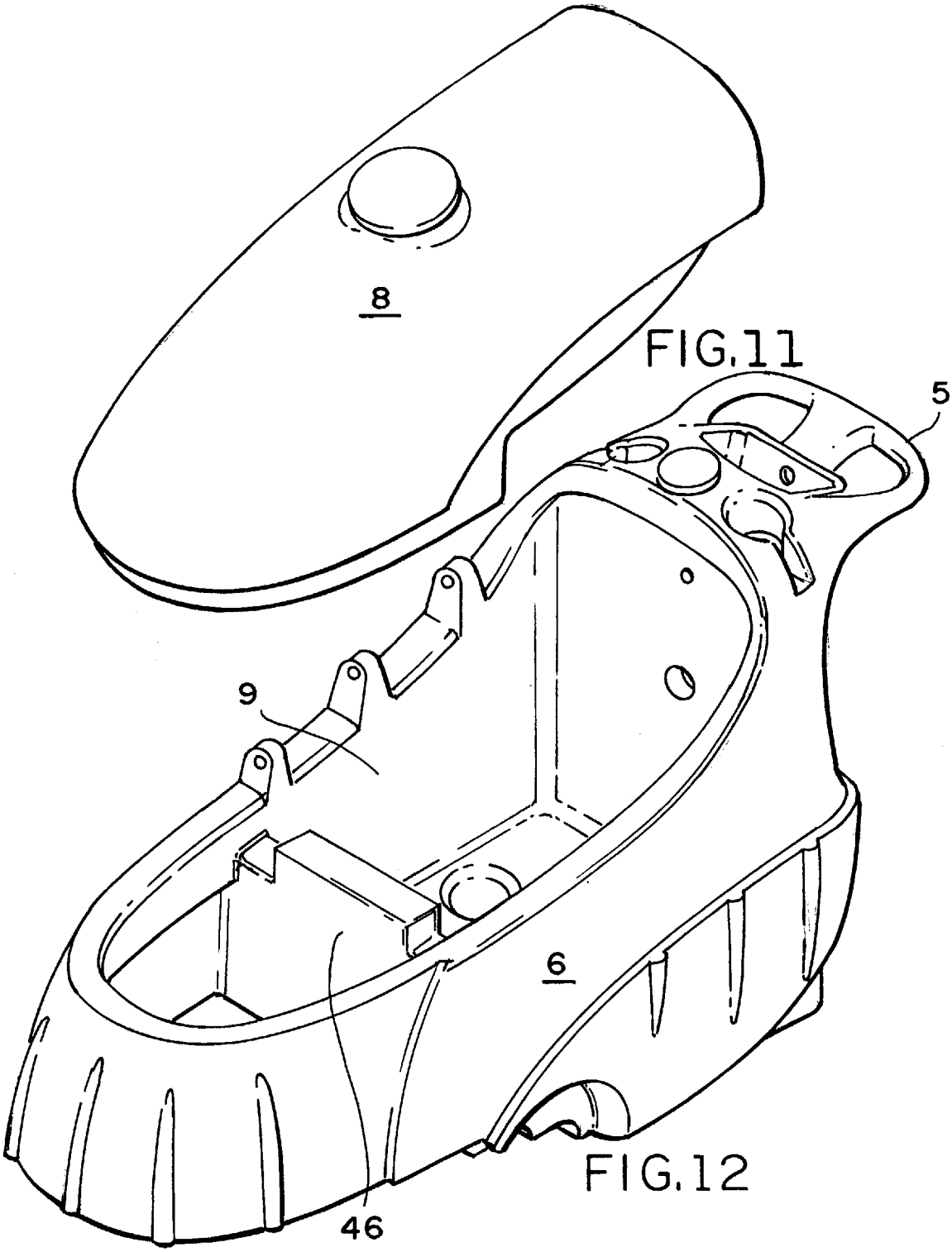
FIG. 11 is a perspective view of the recovery tank.
FIG. 12 is a perspective view of the lower body cleaning fluid reservoir.

More specifically, as shown in FIG. 1, the floor cleaner 1 has a body portion 2 which is made up of a wheel assembly 4, handle 5, lower body 6, casters 7, and a body cover 8. The lower body 6 contains a battery box 9, which battery box is better shown in FIGS. 12–14.

As shown in FIG. 2, a trans-axle power drive 30 provides the power to the wheels 39 to move the floor cleaner 1 in operation. A linkage group 40 is provided at the forward portion of the body 2 and secured thereto as well as secured to the trans-axle. The linkage group 40 includes a height control actuator 41, lift arms 42, an actuator mount 44, and a head angle control 45. The two lift arms 42 as shown converge slightly at the actuator mount 44. Each of the lift arms 42, the height control actuator 41, and the head angle control 45 have pivotal pin connections to the mounting brackets 44 and are intended for coupling to the floor scrubbing head 10 or the carpet cleaning head 80. Each such link, has at each end, a resilient cushion bushing 50 to absorb vibration and unexpected impacts. Thus, the floor cleaner unit 1 is adaptable to the attachment to various floor scrubbing heads or a carpet cleaning head.

The bushings 50 are molded around a five-eighths inch bronze bonded bushing. The bonded bushing receives the clevis pins 17 which pass through the clevis pin mounting ears 12. Molded around the bronze bonded bushing is an SPR synthetic rubber. It is ideally a shore hardness on the A-scale of seventy. It may range between sixty and eighty. The wall thickness of the SPR synthetic rubber is nominally one-half inch. Thus, upon impact there are seven bushings 50 which absorb the impact which is first received by the rotating bumpers 19, then by the lift arms 42, and thereafter by the head angle control 45. These loads are transmitted into the lower frame portion 6, and along with the resilient springs 48, absorb the impact prior to the resilient absorption of the entire body 2 and finally its contained fluid.

In FIG. 3 it will be seen that the floor scrubbing head 10 includes the floor scrubber housing 11 with clevis pin mounting ears 12 on the top of the housing. The clevis pin mounting ears 12 are engaged by the remote ends of the lift arms 42, the height control actuator 41, and the head angle control 45. The purpose of the head angle control 45 is to assure that there is an upward angle between the front and rear of the scrubbing head 10 by stabilizing the potential movement of the lift arms 42. This assists when climbing a ramp, whether in the cleaning or transport modes.

By way of contrast, FIG. 4 illustrates the carpet cleaning head 80 with its housing 81, provided with clevis pin mounting ears 12 to pivotally receive the ends of the lift arms 42, the height control actuator 41, and the head angle control 45 in the same fashion as the scrubber head 10 is secured to the linkage group 40.

Figure 6:
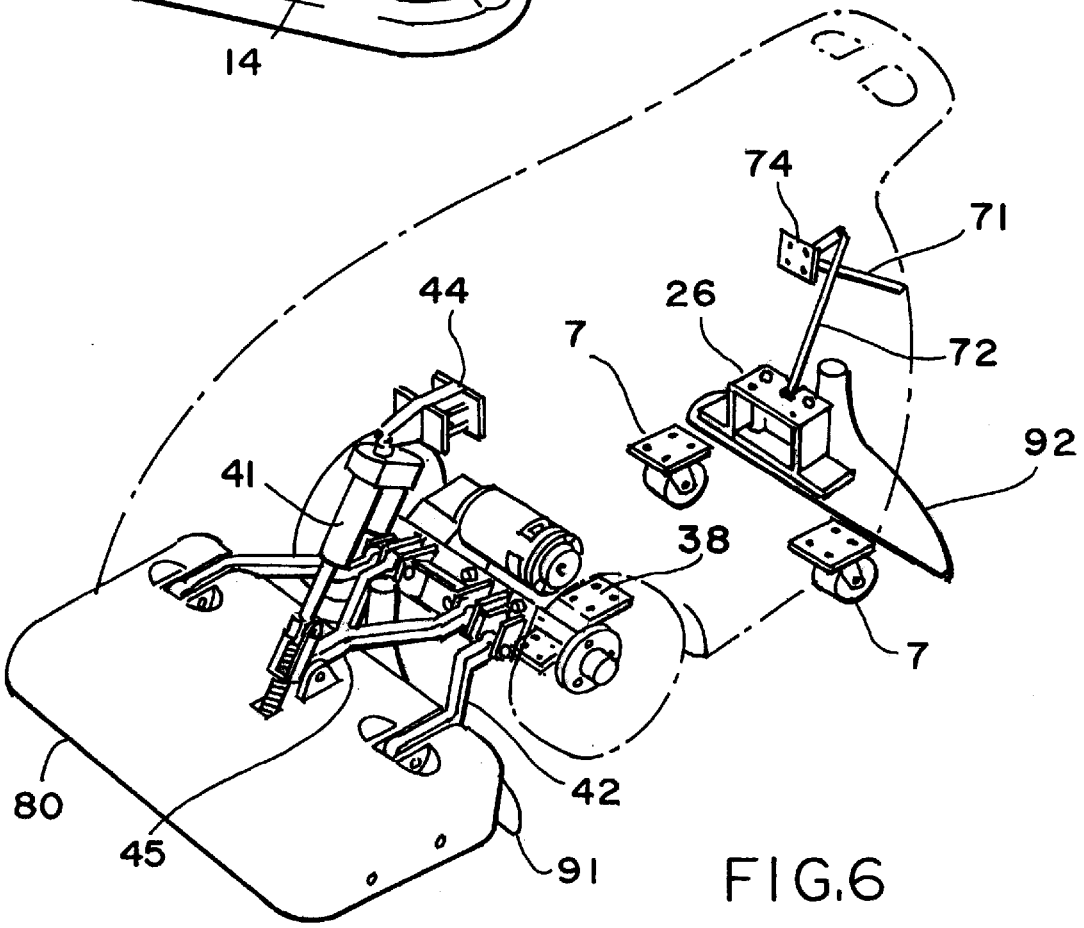
FIG. 6 is a perspective view of a carpet cleaner head and a trailing vacuum nozzle rake assembly illustrating their relationship to the drive assembly, which assembly is shown in dotted lines.

By turning now to FIGS. 5 and 6 it will be seen that the squeegee assembly 20 compliments the floor scrubbing head 10, whereas in FIG. 6, it will be seen that the carpet cleaning head 80 is coordinated with a vacuum nozzle/rake assembly 85. Hence, when the floor scrubbing head 10 is in operation in the configuration such as shown in FIG. 5, the squeegee assembly 20 picks up the fluid which has been discharged and agitated by the brushes. When the carpet cleaning head 80 is in operation, such as shown in FIG. 6, a vacuum nozzle/rake assembly 85 recovers any remaining fluid discharged by the carpet extractor and helps remove tracks left by the wheels and casters.

Figure 7:
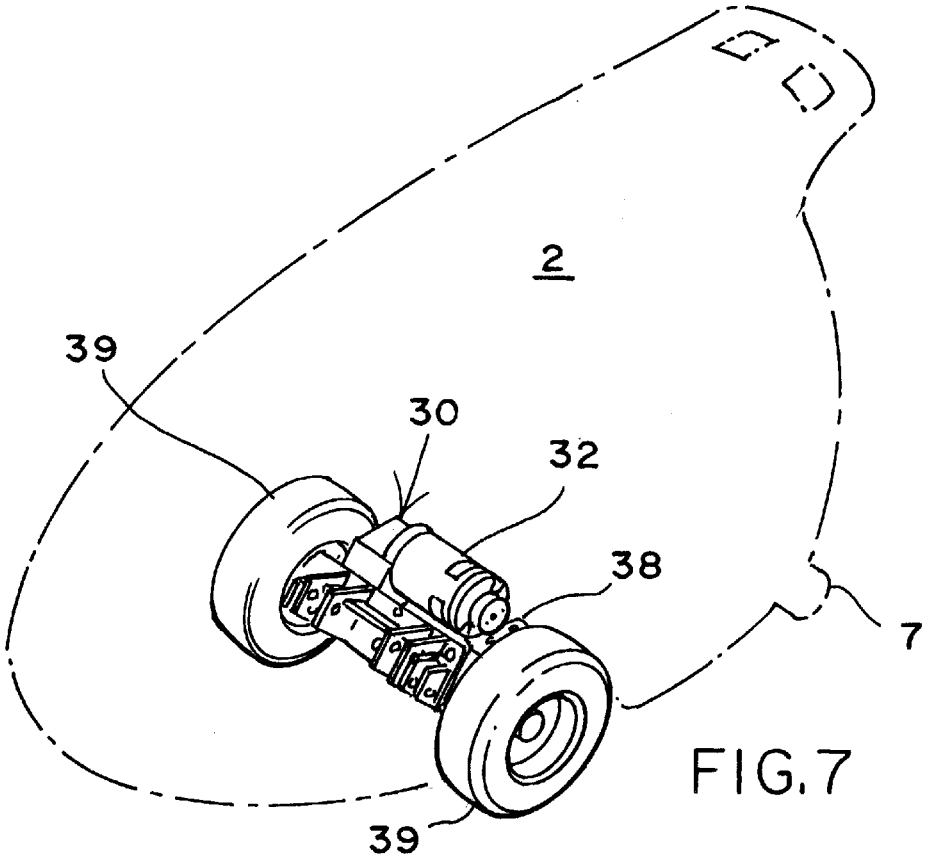
FIG. 7 is a perspective view of the trans-axle drive with both wheels mounted.
Figure 8:
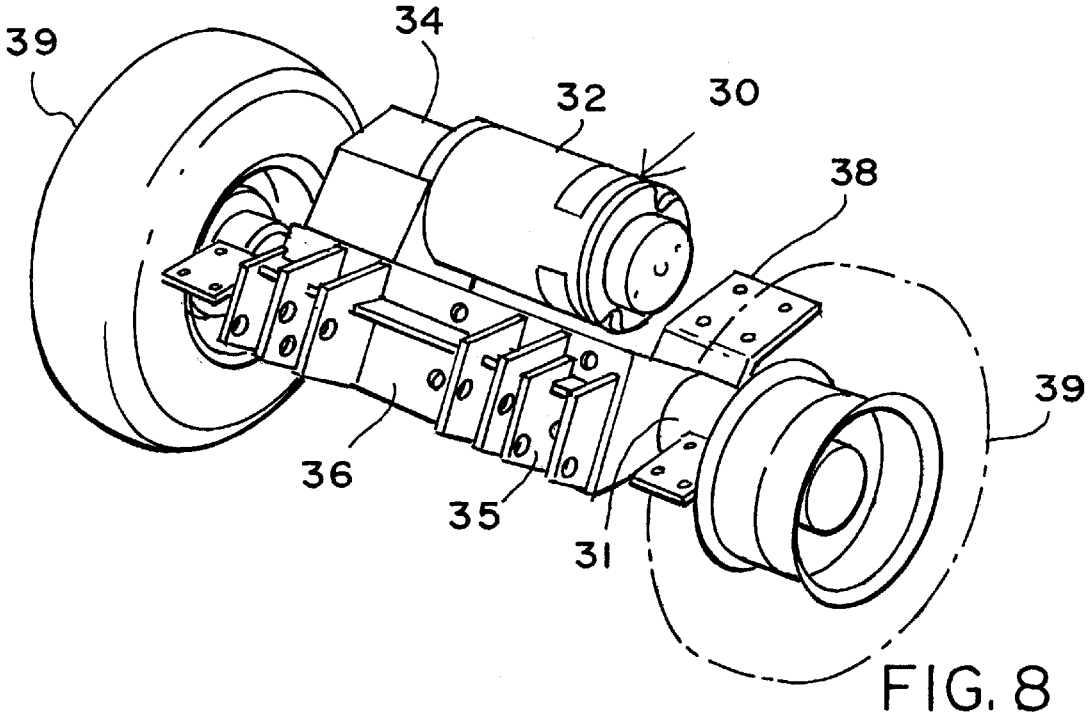
FIG. 8 is an enlarged perspective view of the trans-axle drive illustrating the drive motor, the differential and gearing housing, the two wheels at either end, and the brackets for mounting the linkage which connects to the floor scrubbing or carpet cleaning heads.

The trans-axle power drive 30 will be more fully understood by reference to FIGS. 7,8, and particularly 24. Basically, as shown in FIG. 7, the trans-axle power drive 30 fits underneath the body 2 and is secured thereto by trans-axle torque bracket 38. The torque bracket 38 have a crotch 37 to cradle the trans-axial drive to the lower bottom assembly 6 and secure to the mounting brackets 44. Hence the floor cleaner 1 is supported on the floor by means of the trans-axle power drive 30 and its primary driving wheels 39, assisted by a pair of opposed casters 7 mounted at the rear lower portion of the body 2.

More specifically, it will be seen in FIG. 8 that the trans-axle power drive 30 includes the axle portion 31, a motor 32 which is coupled directly to a gear box/differential 34 for driving the axle 31 to, in turn, rotate the wheels 39. Important to the entire trans-axle power drive 30 are the trans-axle arm mounting brackets 35 which flank the head angle control bracket 36. The two brackets 35 and 36, in turn, co-act with the linkage group to pivotally mount the lift arms 42 and the head angle control 45 (not shown in FIGS. 7 and 8 but shown and described with respect to FIG. 3 above).

Figure 9:
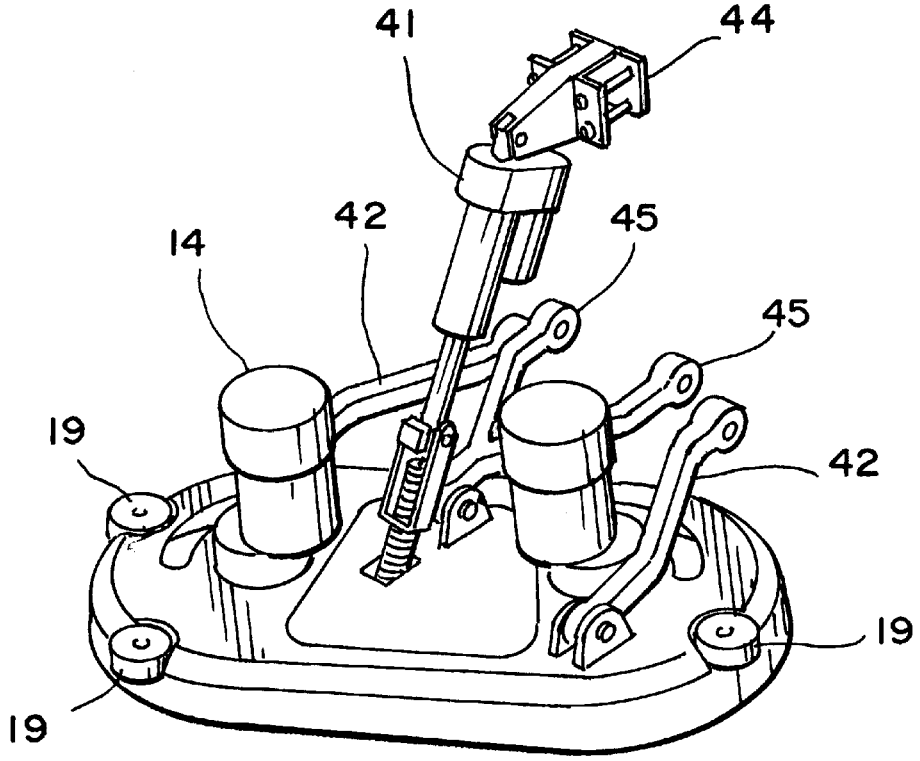
FIG. 9 is a perspective view of a floor scrubbing head.
Figure 10:
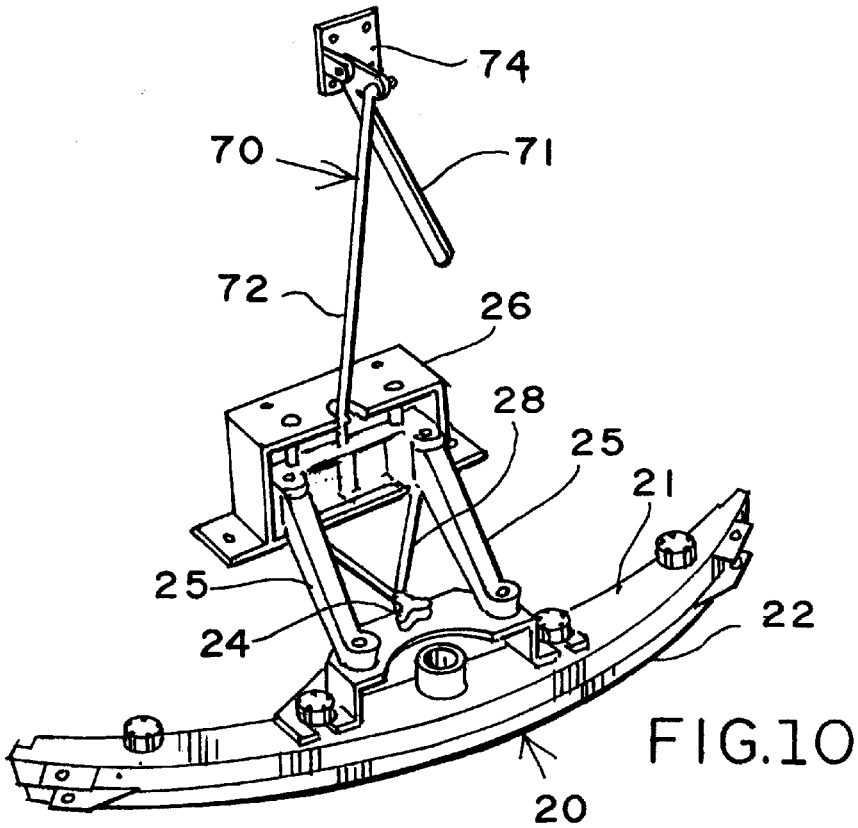
FIG. 10 is a perspective view of a trailing squeegee assembly which is used in the floor scrubbing mode.

FIGS. 9 and 10, taken together, illustrate the sub-assemblies of the floor scrubbing head 10, and squeegee assembly 70 which are mounted to the forward portion and the rear portion of the floor cleaning machine, respectively. Specifically shown in FIG. 9 is the actuator lower housing mount 44. This mount 44 is particularly shown in FIG. 2 where it is secured to bulk head 46 at the upper portion of the lower body assembly 6.

FIG. 10 illustrates the mounting of the squeegee group 20 with its related mounting bracket 74, which mounting bracket 74 is secured to the rear of the lower housing as shown particularly in FIG. 13. The squeegee assembly 20 as shown in FIG. 10 includes the squeegee mount 21 which secures the squeegee blade 22 at its lower portion. The same are secured to a squeegee link bracket 24 which, in turn, pivotally engages the guide linkage arms 25 for the squeegee assembly 20. The guide linkage arms 25 are pivotally secured to the guide link arm mount bracket 26. The arm mount bracket 26, in turn, is secured to the rear end of the body portion as shown in FIG. 13 above the casters 7. A rear lift assembly 70 is shown partially in FIG. 10. This rear lift assembly can accommodate either the squeegee assembly 20, or the vacuum nozzle/rake assembly 85. More specifically, the rear lift assembly 70 is shown in FIG. 13 where it will be seen that a bell crank handle 71 pivotally engages the bracket 74 for mounting the same to the rear portion of the lower tank 6. Depending from the remote end of the handle 71, is the lift rod 72 which depends downwardly to manually actuate upwardly or downwardly either the vacuum nozzle/rake assembly 85, or the squeegee group 20.

In greater detail, the squeegee assembly 20 is shown in FIGS. 18–21. There it will be seen in FIG. 18 that the squeegee assembly 20 has a principal squeegee casting 51 which is substantially crescent shaped and having a front blade support portion 52, a rear blade support portion 54, an open interior vacuum chamber 55, a top 51 and a bottom piece 58.

The front blade 61 which is the first blade to engage the soiled fluid is shown best in FIG. 21. There it will be seen that the front blade 61 has a plurality of mount slots 75 spaced at a mid-position, and front blade water slots 64 for permitting the passage of a portion of the fluid gathered by the front blade 61 into the vacuum chamber 55 interiorly of the casting 51. To be noted is that the front blade 61 has the front blade water slots 64 on both the top and the bottom which permits the blade 61 to be reversed in the event of floor wear or reduced wiping effort. In addition, having the slots 64 on both sides makes the blade reversible and if orientation error occurs in the assembly, the error is rendered harmless. The rear blade 62 as shown in FIG. 21, is essentially the same as the front blade 61 having a plurality of mounting slots 75, but the lower edge and top edge are uninterrupted. In this manner any fluid which is not sucked up by the vacuum housing 55 and suction tube 60, is retained in the vacuum chamber 55 for subsequent removal.

The front blade 61 and the rear blade 62 are held primarily in position by the location blade sets 57 on the periphery of the vacuum chamber bottom 58. The upper portion of the front blade 61 is engaged in a groove on the underside of the housing. The rear blade 61, however, is held in place by a rear blade squeegee band 65 which has a toggle clamp 66 provided at each end mount 68, as best illustrated in FIGS. 18,20. The toggle clamp has a lanyard 67 which is secured to the toggle 66 and rear set 75 of the casting 51 and passes through the notched ends 63 of the blades. This overlappingly secures and seals the ends of both blades to define the vacuum chamber 55.

While the bottom 58 is secured in place by a plurality of machine screws, as shown in FIGS. 18 and 20. The top of the casting 51 has a plurality of knobs 59 for receiving the machine screws 69 and securing them in place while at the same time securing the bottom 58 to the housing casting 51.

The method of operating the squeegee results from the provision of a vacuum chamber 55 which is flanked by the front blade 61 and the rear blade 62. The suction tube adapter 60 at the top of the casting 51 is in open communication with the vacuum chamber 55, and the soiled fluid contained interiorly by the front blade and the rear blade is sucked up by a negative pressure created in the recovery tank body cover assembly.

Figure 15:
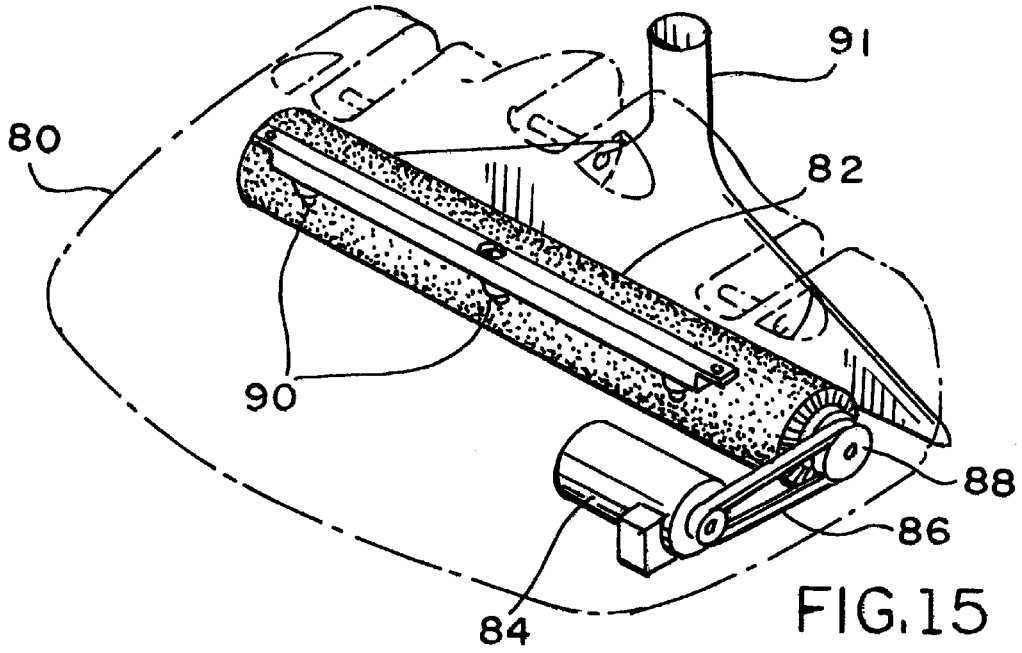
FIG. 15 is a broken perspective view of the carpet cleaning head, showing the head in phantom lines and revealing in greater detail the working mechanism.
Figure 16:
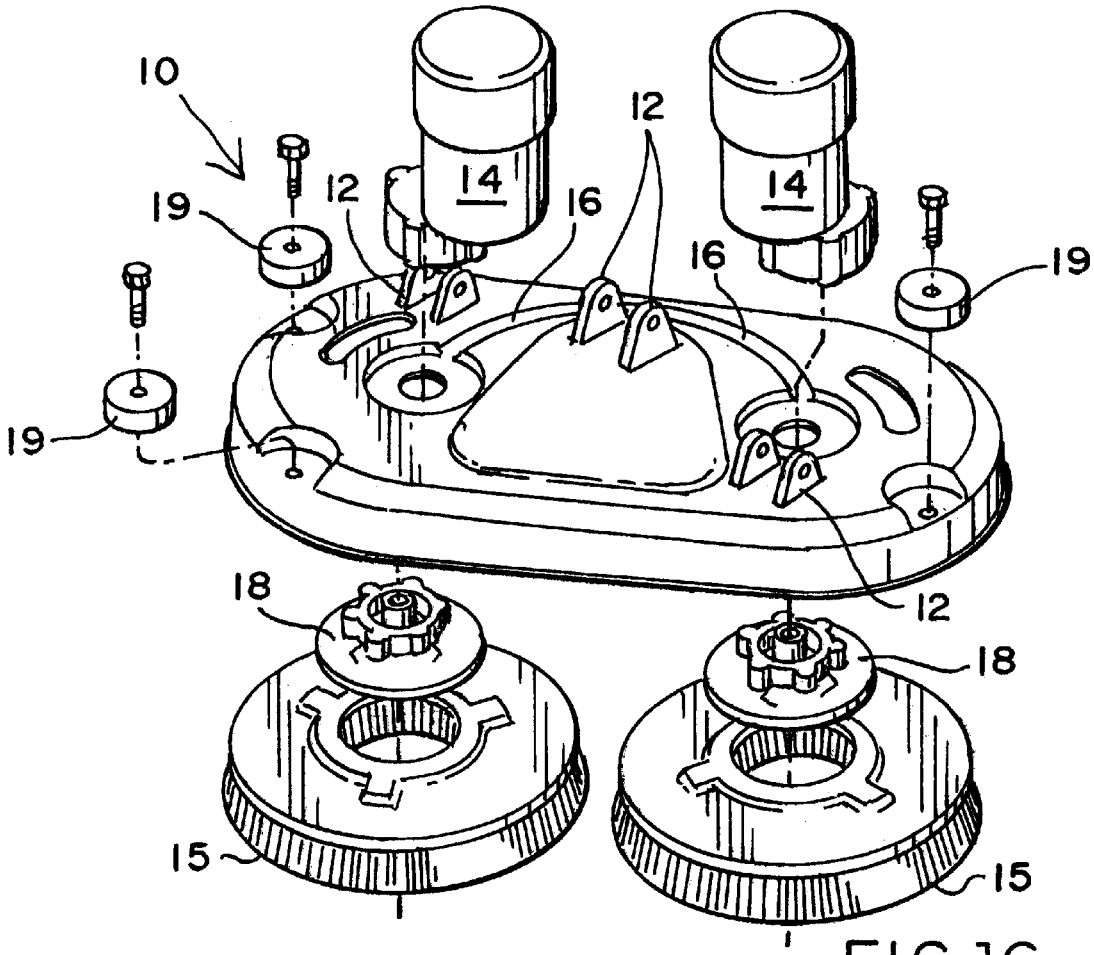
FIG. 16 is a perspective exploded view of the floor scrubbing head illustrating the motors and brushes and their respective relationship to the housing.

Before describing the plumbing system, and the fluid flow in connection with the operation of the subject floor cleaner, further details of the two accessories, scrubbers 10 and carpet cleaner 80, are shown in FIGS. 15 and 16. There it will be seen particularly in FIG. 16 that provision is made in the scrubber 10 for a cleaning solution manifold 16 to receive fluid from the cleaning fluid reservoir in the hollow lower body 6 and transmit the same directly to the brush mounts 18 which, in accordance with standard scrub brushes, permits the water to be centrifugally driven through the entirety of the scrub brushes 15 and hence to the floor which is being cleaned. Also it should be noted that rotating bumpers 19 are provided at three locations on the floor scrubbing head 10.

The carpet cleaning head 80 is contained within housing 81, which is shown in FIG. 15. The carpet brush 82 is driven by the motor drive 84 which is connected by means of belts 86 to the pulley 88 on the end of the brush 82. A spray nozzle assembly 90 in the form of a manifold receives fluid from the cleaning solution contained in the lower body 6. Additionally, a pick-up nozzle 91 is secured to the carpet cleaner housing 81 to pick up the agitated fluid from the carpet. Separately, and optionally, as previously commented upon with regard to FIG. 6, a rear vacuum nozzle/rake assembly 85 further addresses any remaining fluid in the carpet and reducing the track marks made by the drive wheels 39 and the casters 7.

Figure 14:
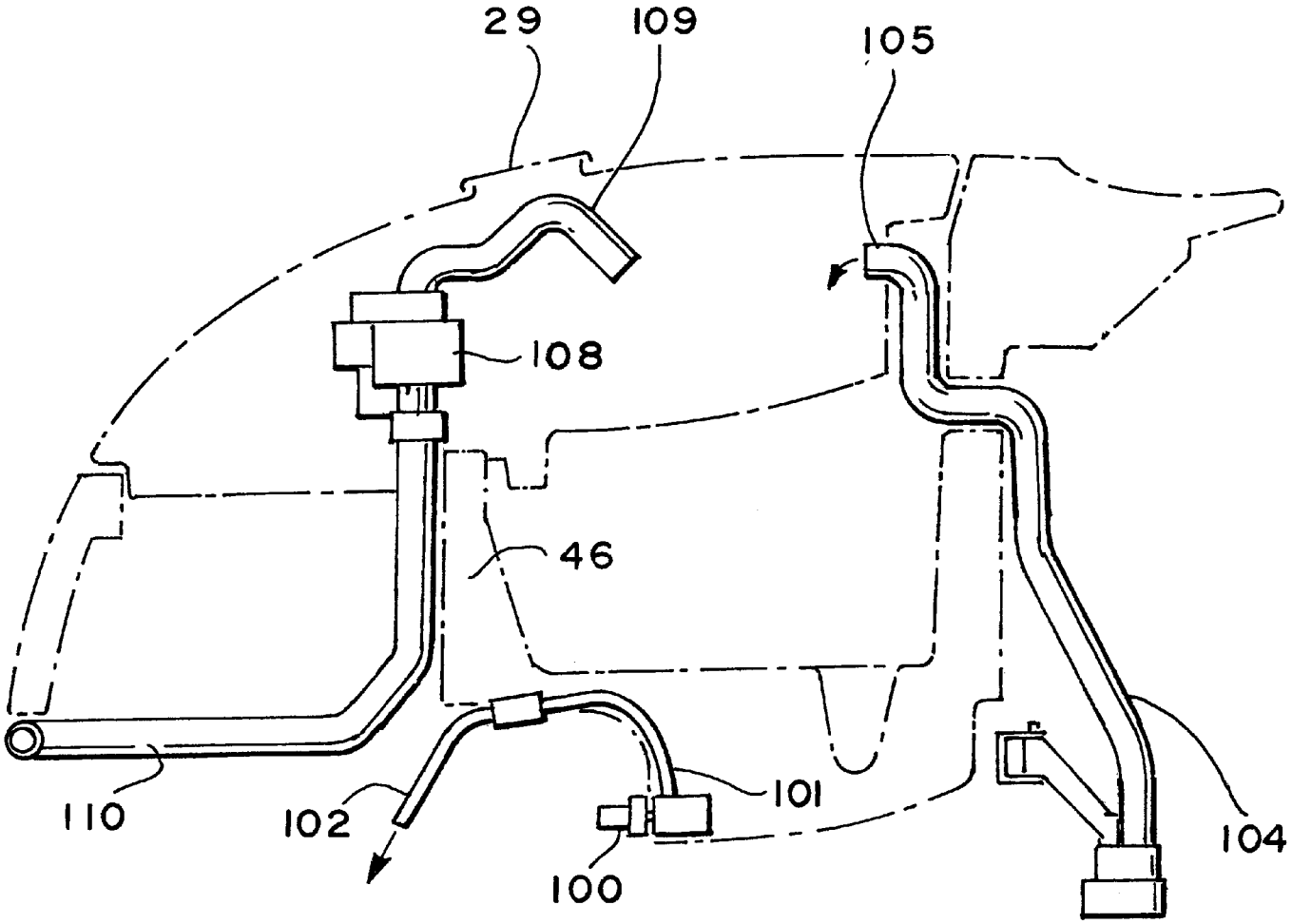
FIG. 14 is a partially diagrammatic view of the plumbing involved in the squeegee assembly particularly in the squeegee and the solution recovery line.

The fluid distribution is best illustrated in FIG. 13 and FIG. 14. As will be seen in FIG. 13, the hollow body cover 8 contains the recovered fluid. This recovered fluid can be monitored through the water site 29 provided at the top of the cover 8. The water level as shown is nearing the top of the recovery tank 8. The cleaning solution level in the lower body portion 6 is also shown. At this point it should be remarked that neither the body cover 8 nor the lower body 6 is to be totally filled with fluid. Accordingly, in the event the unit should crash into a wall, a good portion of the kinetic energy upon the impact will be absorbed by moving both the recovered solution in the body cover 8 and the cleaning solution in the lower body 6. Additionally, the impact is also absorbed by resilient bushings 50 mounted on the two ends of the lift arms 42, and the two ends of the head angle control 45 as is depicted in FIGS. 3 and 4. Similarly the connection between the height control actuator 41, the floor scrubber housing 11 and the carpet cleaner housing 81 are provided with resilient springs 48. Moreover, the hollow lower body 6 is roto-cast of a resilient plastic material as is the body cover 8. As a consequence dynamic impact is first absorbed by the bumpers 19, then the resilient bushings 50 secured to the lift arms 42, and in addition the springs 48 followed by a translation of the impact to the roto-cast body 6 and cover 8, and finally by the shifting of the contained fluids within the unit. This is to be contrasted with the prior art where the impact is absorbed by lifting the entire floor cleaning assembly. In the prior art, therefore, advantage is not taken of the resilient mounting relationship between the impacting housing and the body, nor the resiliency of the body itself. The prior art accents lifting the entire floor cleaning assembly lest the impact be transferred to the rigid frame. Finally, while the fluid may be raised, the fluid in the instant construction is caused to move in any direction it seeks to move in accordance with Newton's law, namely, to every action there is an equal and opposite reaction.

In concluding with regard to the fluid, attention is directed to the plumbing diagram shown in part in FIG. 13, and more specifically in FIG. 14. Specifically in FIG. 14, it will be seen that the initial discharge of cleaning solution from the lower body 6 is accomplished by a pump 100 at the lower portion of the lower body 6. The pump 100 directs fluid through the brush head supply line 101 to the brush head outlet 102.

Thereafter, the fluid is picked up by the squeegee assembly 20 through the solution recovery line 104, which has a discharge end 105 releasing the fluid into the body cover/recovery tank 8. The fluid is caused to migrate by the vacuum motors 108 and the water height control line 109. Thus, the vacuum supplied creates a negative pressure inside the recovery tank 8 which in turns sucks the fluid up from the squeegee assembly 20. When the body recovery tank 8 is full, an overflow directs the fluid downwardly to the drain 110. Normally the drain 110 is not activated until such time as the cleaning cycle has been concluded and the operator observes the recovery water through the recovery water site 29.

In FIG. 17 the level of the two fluids can be observed by the imaginary cutting through the plane above the trans-axle 30. There it will be seen that the batteries 65 are effectively cradled interiorly of the lower body 6. Also as stated earlier, the entire floor cleaner assembly 1 is so proportioned that the center of gravity of the combined fluid in the body cover/recovery tank 8 and the lower body cleaning fluid tank 6, and the batteries 65 are toward the steering handle 5 and away from the trans-axle power drive 30 thereby inhibiting tipping forwardly.

The electrical circuitry takes the current from the batteries, three 12 volt batteries in series, to provide a 36 volt circuit. This is distributed through the control panel at the handle 5 to the suction pump 111 which creates the vacuum in the body cover/recovery tank 8, and the fluid flow pump 100 which distributes the cleaning fluid through the brush head supply line 101 to the brush head outlet 102. The operator is provided with a control for setting two forward speeds. One is the operating mode and the other is the transport mode. To go into reverse, which is also provided, a pair of interlock switches are provided at the power head unit and at the squeegee or trailing unit. Until both are raised, the entire assembly cannot be put into reverse. Separately means are provided on the raising and lowering of the forward unit by actuating the height control actuator 41 to transfer a portion of the load of the remainder of the machine to the power head in order to apply additional pressure in the brushes while in the scrubbing mode. As to the squeegee unit, it is powered by the vacuum which, however, is always on when the power head is scrubbing. Various means are contemplated to correlate and interact the subject functions, but the invention is primarily directed to the power assembly and its features for floor treatment, as distinguished from the various circuitries which can be applied for control.

The Method

The method of the present invention is fulfilled by providing a single floor cleaner 1 which is adaptable to become either a floor scrubber of various widths and modes or a carpet extractor. The method, however, includes providing such a floor cleaner 1 which has a two-piece body 2, a lower body portion 6, which is rotocast to be hollow for containing cleaning fluid, and an upper portion, the body cover 8, which is hollow for containing the recovered solution or fluid. The fluids employed can be for either cleaning a hard floor or for cleaning a carpet. Important to the invention is the provision of a linkage group 40 at the forward portion of the floor cleaner 1, and a squeegee link bracket 24 and its related assembly at the rear portion of the unit, which bracket can be employed for either supporting a squeegee 20 for the floor scrubbing mode, or a vacuum nozzle/rake assembly 85 for the carpet cleaning mode.

The clevis pin mounting ears 12 on top of the scrubber head assembly 10 are positioned to insure that the housing relationship to the power unit 1 is optimum, controlling the trans-axle direction as well as the front to rear direction. By so conforming the floor scrubbing head 10 and carpet cleaning head 80, the single power unit 1 can be readily adapted in the course of assembly at the factory, or distributor, for the customer's particular order as to the embodiment he desires. Moreover, for foreign manufacture, the molded body 2 with lower tank 6 and cover 8 can be molded at the assembly site, and the balance of the parts compactly shipped. Finally, the height control activator 41 and power sensor are provided at the front of the power unit 1 for raising either the scrubber housing or the carpet extractor housing, and similarly a rear lift control assembly 70 is provided at the rear portion of the floor cleaner for raising or lowering the squeegee assembly or the vacuum nozzle/rake assembly. The squeegee and the vacuum nozzle recovery cleaning fluid from the floor or carpet through a flow pick-up line into the body cover/recovery tank 8.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A floor cleaning machine having a body and a wheel supporting assembly, comprising, in combination, a hollow body portion having means for securement to a trans-axle power unit and casters at the rear of the hollow body portion, said hollow body having a hollow body lower solution tank and a hollow body cover solution tank for the lower solution tank, a trans-axle power unit secured transversely to the hollow body lower solution tank perpendicular to the direction of movement of the floor cleaning machine, coupling means, including impact cushioning means, at a forward portion of the lower solution tank and forward of the trans-axial power unit for interchangeable securement to a floor scrubbing head or a carpet cleaning head, whereby a single floor cleaning machine body can be used selectively as a floor cleaner for scrubbing hard floors or as a carpet extractor for covering carpeted floors, said coupling means comprising a head angle control having one end secured to the forward portion of the trans-axle power unit and another end removably secured to the floor cleaning head or carpet cleaning head to be employed, pivotal lift arms secured at one end to the trans-axle power unit and removably secured at the other end to the floor scrubbing head or carpet cleaning head, and a height control actuator removably secured at one end to the floor scrubbing head or carpet cleaning head and secured at the other end to the lower solution tank, whereby the floor cleaning head or carpet cleaning head is removably secured to the floor cleaning machine and is capable of being raised or lowered by the height control actuator toward or away from a floor surface to be cleaned.

2. For use with a power drive of a floor cleaning machine, a floor scrubbing head, said scrubber head comprising, in combination, a pair of spaced motors, a floor scrubber housing securing said motors in position for driving brushes there beneath, a rotating scrub brush secured to each respective spaced motor, pivotal lift arms and a head angle control removably and pivotally secured at first ends to the scrubber housing, wherein second ends of the pivotal lift arms and head angle control pivotally engage the power drive, a scrubber powered lift link removably secured to a mid-portion of the scrubber housing, and means for securement of the lift link to a lower body portion of the floor cleaning machine such that the lift link is capable of raising and lowering the scrubber head into and out of contact with a hard surface floor when the lift link is secured to the lower body portion.

3. For use with a floor cleaning machine having a height control actuator and a power drive with forward extending pivotal links and a head angle control, a carpet extractor head, said carpet extractor head comprising, in combination, a power driven rotary brush for removable securement to the forward extending pivotal links, a manifold for distributing cleaning fluid above the power driven rotary brush, means on said carpet extractor head for pivotal engagement with the pivotal links and the head angle control of the power drive, and means for securement of the carpet extractor head to the height control actuator such that, when the carpet extractor head is secured to the floor cleaning machine by the pivotal links, head angle control and height control actuator, the carpet extractor head is capable of being raised and lowered into and out of contact with a carpet surface.

4. A floor cleaning power unit propulsion pod comprising, in combination, a trans-axle drive means, a monocoque body portion formed by a cover and a lower housing, whereby the cover and lower housing form a frameless propulsion pod, each of said cover and lower housing being hollow fluid retaining tanks for holding a cleaning solution or a recovered solution, said lower housing being secured to the trans-axle drive means, and means for securing a floor engaging cleaning unit to a forward portion of said power unit propulsion pod, said means for securing a floor engaging cleaning unit comprising a head angle control having one end secured to a forward portion of the trans-axle drive means and the other end removably secured to the floor engaging cleaning unit, pivotal lift arms secured at one end to the trans-axle drive means and removably secured at the other end to the floor engaging cleaning unit, and a height control actuator removably secured at one end to the floor engaging cleaning unit and secured at the other end to the lower housings, whereby the floor engaging cleaning unit is removably secured to the floor cleaning power unit propulsion pod and is capable of being raised or lowered by the height control actuator toward or away from a floor surface to be cleaned.

5. The floor cleaning power unit propulsion pod of claim 4, further comprising:

a cradle area in the lower housing for supporting batteries which provide power for the trans-axle drive means.

6. The floor cleaning power unit propulsion pod of claim 4 in which:

resilient bushings are provided at connection points between the other end of the pivotal lift arms and the floor engaging cleaning unit and the other end of the head angle control and the floor engaging cleaning unit, whereby upon impact of the propulsion pod with an obstruction the resilient bushings will absorb kinetic energy at the connection points.

7. A floor cleaning machine having a hollow body portion, a lower body assembly, a body cover assembly, a wheel assembly, a trans-axial power drive for the wheel assembly, a battery box, a floor engaging cleaning member, and a plurality of batteries housed in the battery box, the improvement comprising:

the foregoing items all being formed, proportioned and positioned so that their combined center of gravity at all times will be positioned rearwardly of the trans-axial drive and wheel assembly, whereby tipping forwardly is inhibited during movement of the floor cleaning machine when fluid is held within the hollow body portion, said floor engaging cleaning member extending forwardly of the lower body assembly, and coupling means, including impact cushioning means, for securing the floor engaging cleaning member to the floor cleaning machine, said coupling means comprising a head angle control having one end secured to a forward portion of the trans-axle power drive and the other end removably secured to the floor engaging cleaning member, pivotal lift arms secured at one end to the trans-axle power drive and removably secured at the other end to the floor engaging cleaning member, and a height control actuator removably secured at one end to the floor engaging cleaning member and secured at the other end to the lower body assembly, whereby the floor engaging cleaning member is removably secured to the floor cleaning machine and is capable of being raised or lowered by the height control actuator toward or away from a floor surface to be cleaned.

* * * * *